US005333324A

United States Patent [19]

Pinciaro

[11] Patent Number: 5,333,324

[45] Date of Patent: Aug. 2, 1994

[54] HYDROTHERAPY HOT TUB STRUCTURE FOR NECK AND SHOULDER MASSAGE

[76] Inventor: John Pinciaro, 451 Moose Hill Rd., Monroe, Conn. 06468

[21] Appl. No.: 972,943

[22] Filed: Nov. 6, 1992

[51] Int. Cl.[5] ..... A47K 3/02

[52] U.S. Cl. ..... 4/567; 4/492; 4/538; 4/541.1; 4/541.6; 4/559; 4/568

[58] Field of Search ..... 4/538, 492, 506, 507, 4/513, 537, 541.1, 541.6, 546, 559, 567, 568, 589, 590, 591, 569, 570; 128/66

[56] References Cited

U.S. PATENT DOCUMENTS

| | | | |
|---|---|---|---|
| 972,589 | 10/1910 | Winters | 4/569 |
| 1,532,714 | 4/1925 | Paul | 4/567 |
| 3,605,735 | 9/1971 | Soden | 4/492 |
| 4,339,833 | 7/1982 | Mandell | 4/492 |
| 4,679,258 | 7/1987 | Harkin | 4/542 |
| 4,692,950 | 9/1987 | Harkin | 4/542 |
| 4,727,605 | 3/1988 | Harkin | 4/542 |
| 4,825,854 | 5/1989 | Harkin | 128/66 |
| 4,839,930 | 6/1989 | Watkins | 4/546 |
| 4,896,383 | 1/1990 | Morgan | 4/541.6 |

FOREIGN PATENT DOCUMENTS

| | | | |
|---|---|---|---|
| 3240330 | 5/1984 | Fed. Rep. of Germany | 4/541.6 |
| 3903477 | 8/1990 | Fed. Rep. of Germany | 4/541.6 |

*Primary Examiner*—Henry J. Recla
*Assistant Examiner*—Gregory Vidovich
*Attorney, Agent, or Firm*—John K. Conant

[57] ABSTRACT

Structure for neck and shoulder massage in a hydrotherapy hot tub consists of a pillow element against which a person's head rests with a cavity in the pillow element through which a stream of fluid is directed toward the person's neck. The structure includes a surface interposed in the stream of fluid to deflect the stream to impinge on the person's neck downward at an adjusted acute angle thereto. Another form of the structure includes wing portions extending over the shoulders of a person whose head and neck are at the pillow element with conduits and nozzles at spaced intervals directing streams of fluid downward from the undersides of the wing portions onto the shoulders of the person.

7 Claims, 6 Drawing Sheets

HYDROTHERAPY HOT TUB STRUCTURE FOR NECK AND SHOULDER MASSAGE

FIELD OF THE INVENTION

This invention relates to hydrotherapy hot tubs which are hot tubs or bath tubs with whirlpool appliances mounted in them or the like, in which streams of warm water, or water with air entrained therein, are circulated against the body of a person in the tub for therapeutic or relaxing purposes.

BRIEF SUMMARY OF THE INVENTION AND PRIOR ART

This invention is a pillow structure in a hydrotherapy hot tub for directing a stream Of a fluid, warm water or water with air entrained therein, at an acute downward angle against the neck of a person who is in the tub with his/her neck adjacent to a pillow or pillow portion of the tub wall at the upper part of the tub wall which defines a station of the tub in which the body of the person using the tub reposes.

The pillow has a cavity therein and a conduit from a source of fluid under pressure is connected to direct a stream of the fluid through the cavity toward the back of the neck of a person who is in the reposing station of the tub with his/her back against the tub wall and his/her head and neck adjacent to the pillow portion. A wall surface of the cavity or an angularly adjustable vane in the stream of fluid that is directed through the cavity is interposed in the stream to direct it downward to impinge on that person's neck at an acute angle, thereby therapeutically massaging and relaxing the person's neck and upper back muscles.

In another embodiment of the invention wing elements extend from the pillow portion to extend over the shoulders of a person in the tub with the back of his/her head and neck at the pillow portion. In this embodiment, in addition to the stream of fluid directed through the cavity in the pillow portion to impinge on the neck of a person in the tub, other streams of the fluid are conducted outward through the wing elements and are directed downward at spaced intervals along the undersides of the wing elements to impinge on the shoulders of a person at the repose station in the tub.

From a preliminary patentability search that was conducted in connection with this disclosure, the most pertinent prior art that was located is a U.S. Pat. No. 4,860,392 to Gardenier et al. for a Hydotherapy Massage Unit. The Gardenier et al. patent disclosed a unit mounted on the wall of a hydrotherapy tub for directing a stream of fluid downward, coplanar with the surface of the tub, to direct the massaging stream down the person's back, along the spine.

In contradistinction the pillow structure of the present invention directs a stream of fluid downward against the neck of the person at an acuate angle thereto, and, in another embodiment, additionally directs other streams of fluid down against the person's shoulders, for massaging the neck, or the neck and shoulders.

Other known devices for massaging a person's neck and shoulders with a stream of fluid are hand held shower head-like devices that connect onto a shower head so that the person can direct a pulsating stream of fluid where he/she wishes. This of course requires physical activity and some agility of the person to direct the fluid stream to the back of the neck and shoulders, which at least partially defeats the purpose of a relaxing massage. On the other hand, with the pillow structure of the present invention, the person seeking the therapeutic or relaxing massage for a sore or stiff neck and shoulders, can relax completely so that the massaging action of the fluid streams achieve maximum effectiveness by working on relaxed muscles.

BRIEF DESCRIPTION OF THE DRAWINGS

Further objects, advantages and features of the hydrotherapy hot tub structure of this invention are described below with reference to the accompanying drawings of preferred embodiments of the invention in which.

DETAILED DESCRIPTION

Figure 1:
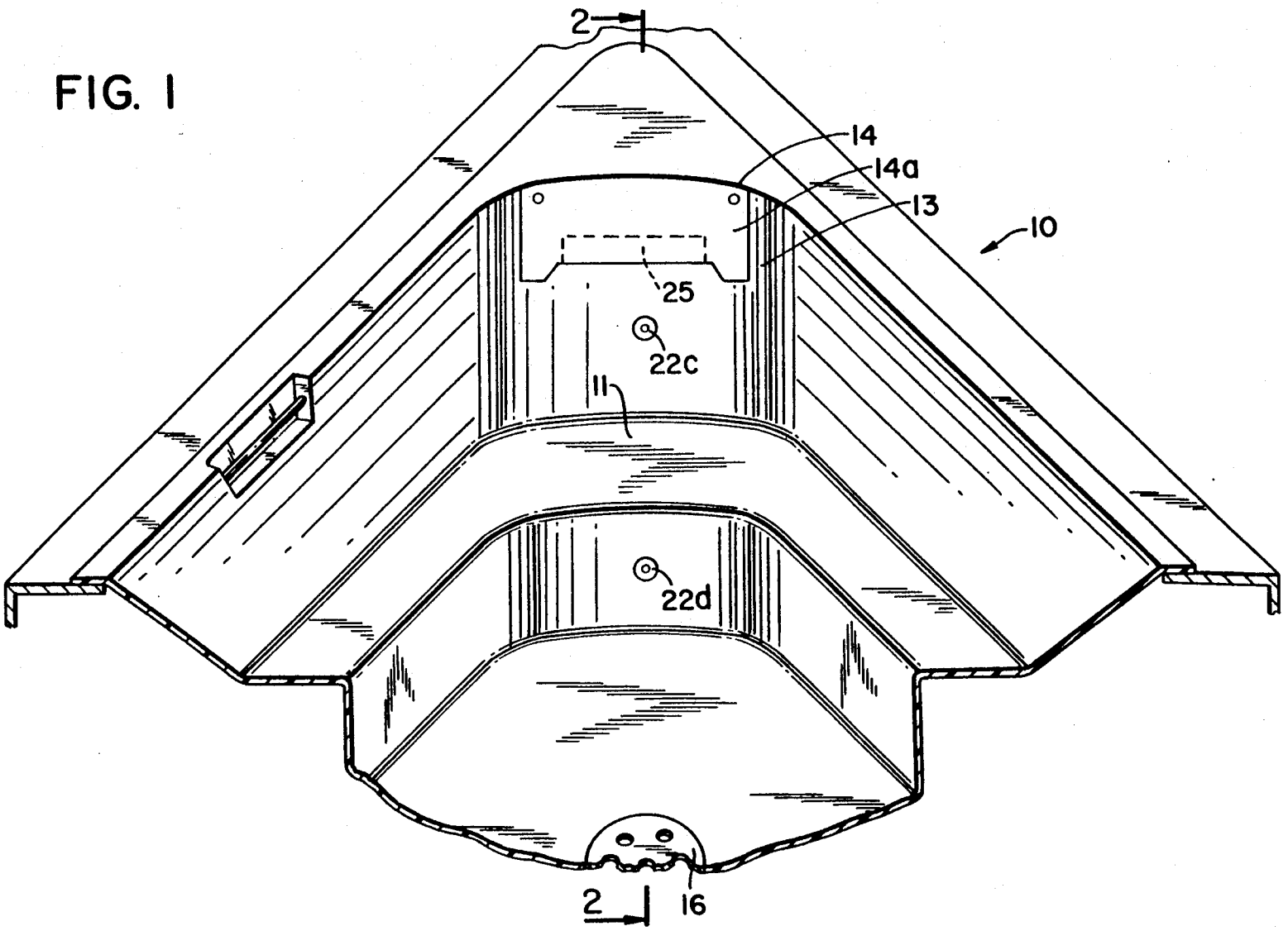
FIG. 1 is an isometric view of a section of a hydrotherapy hot tub showing a station of the tub in which a person using the tub reposes and showing a pillow structure embodying the invention.
Figure 2:
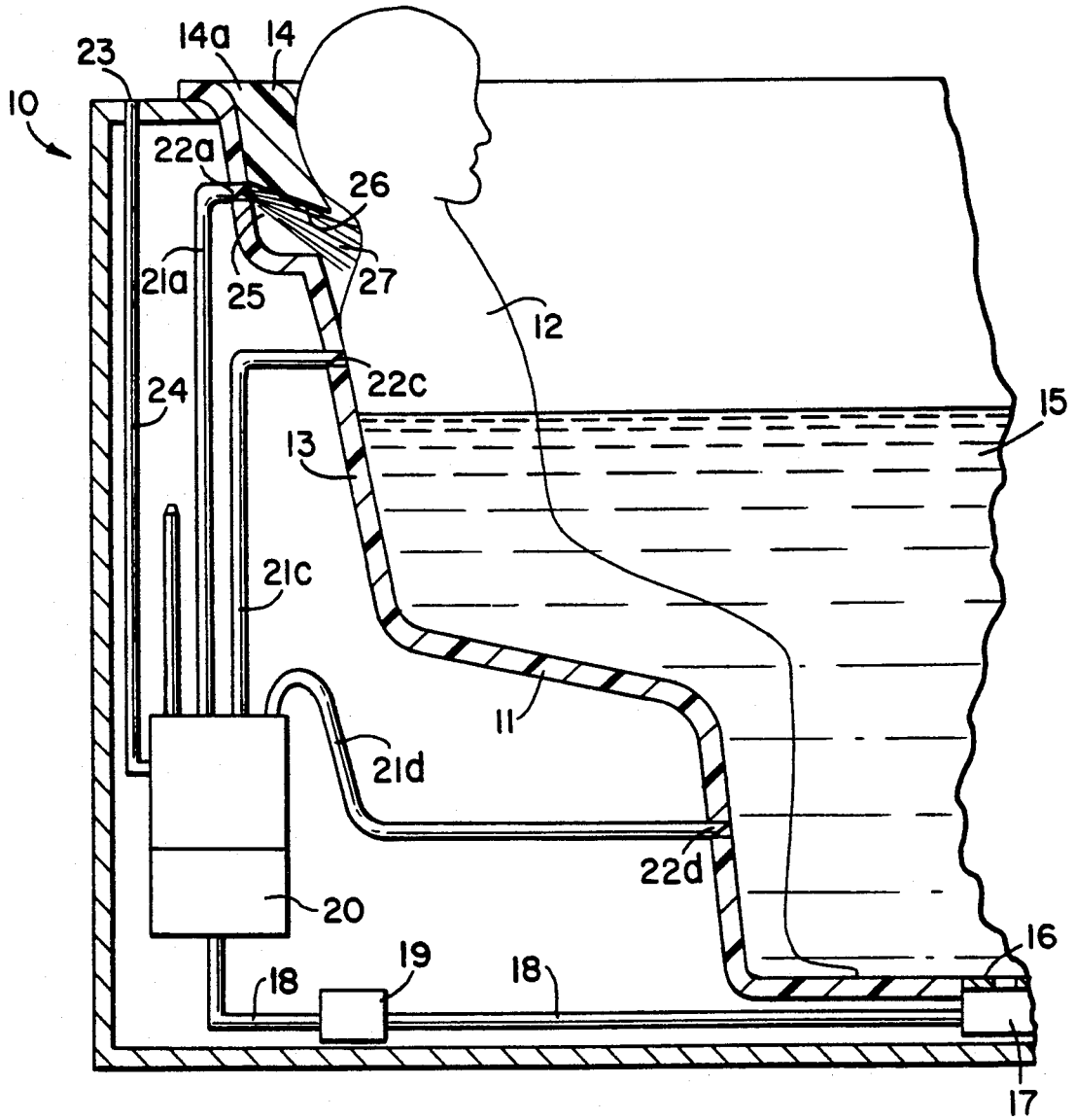
FIG. 2 is a section along the lines 2—2 of FIG. 1, partly schematic, and indicating in outline the body of a person in the repose station of the tub.

Referring now to FIGS. 1 and 2 of the drawings a therapeutic hot tub 10 typically has a station contoured for a person to repose thereat in relaxed comfort. The repose station illustrated in FIGS. 1 and 2 has a seat portion 11 on which a person, indicated in outline 12 in FIG. 2, sits with his/her head and neck adjacent to the upper portion of the tub wall 13 at which pillow structure 14 in accordance with this invention is located. The tub wall 13 , as shown, is slightly inclined but generally vertical for supporting the back of a person 12 sitting on the seat portion 11. The specific contour of the repose station of the tub is not critical to this invention. The repose station could be couch-like for a person to be supported in a supine position, for example. The only requisite for the structure of the present invention is that the repose station for a person using the therapeutic hot tub have a pillow area adjacent to which the head and neck of a person at the repose station will be positioned. In FIGS. 1 and 2 the pillow area is coincident with the pillow structure 14 of this invention.

Looking at FIG. 2, which illustrates a typical therapeutic hot tub, the tub is filled with water, indicated at 15, which is circulated through the tub. The water passes down through a grating 16 in the bottom of the tub into a sump 17 from which it is conducted by a hose 18 through a filter 19 to a pump and heating unit 20 at which the water is heated to a desired temperature, as controlled by a conventional form of thermostat, not shown, and then pumped under pressure through hoses, indicated by hoses 21*a*, 21*c* and 21*d* to jets or nozzles, indicated by nozzles 22a, 22c and 22d, which discharge streams of the water into the tub with turbulence at various points within the tub. The therapeutic turbulent action of the water customarily enhances by entraining air in the streams of water. This may be accomplished by conducting air into the streams of water emerging from the pump in unit 20 by venturi action, for example, by conducting air from a vent 23 through a tube 24 into the unit 20 in which the tube 24 opens into a conduit through which water under pressure from the pump in unit 20 passes to the hoses 21a–21db to the various nozzles.

In a preferred form of the pillow structure 14 of this invention the structure consists of a resilient, generally rectangular pillow element 14a fixed into a matching recess in the upper portion of the tub wall 13. The pillow element 14a has a cavity 25 in it with the lower front of the cavity opening into the tub in an area which will be adjacent to the head and neck of a person 12 seated at the repose station shown. The nozzle 22a in the rear wall directs heated water, with air entrained in it, under pressure through the rear wall of the cavity. The front wall 26 of the cavity 25 is slanted and located so as to be interposed in the stream of water shooting out of the nozzle 22a for directing that stream of water downward at an angle to impinge upon the neck of the person 12 at an acute angle in the manner illustrated in FIG. 2 by the stream of water 27. By thus being directed at an acute angle downward against the person's neck the turbulent water-air stream therapeutically massages a large portion of the neck and upper back of the person.

Figure 3:
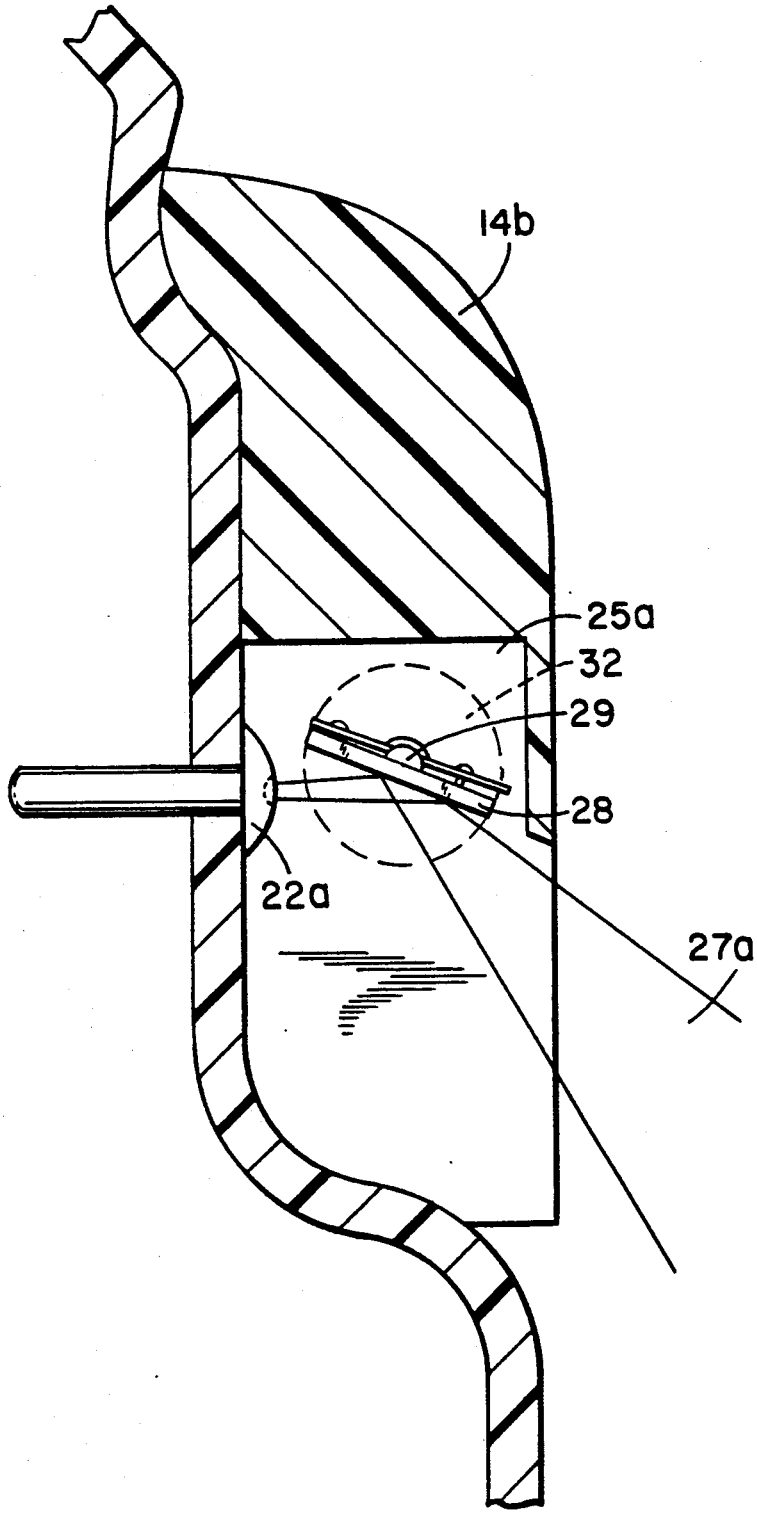
FIG. 3 a vertical section through an alternative form of the pillow structure of this invention.
Figure 4:
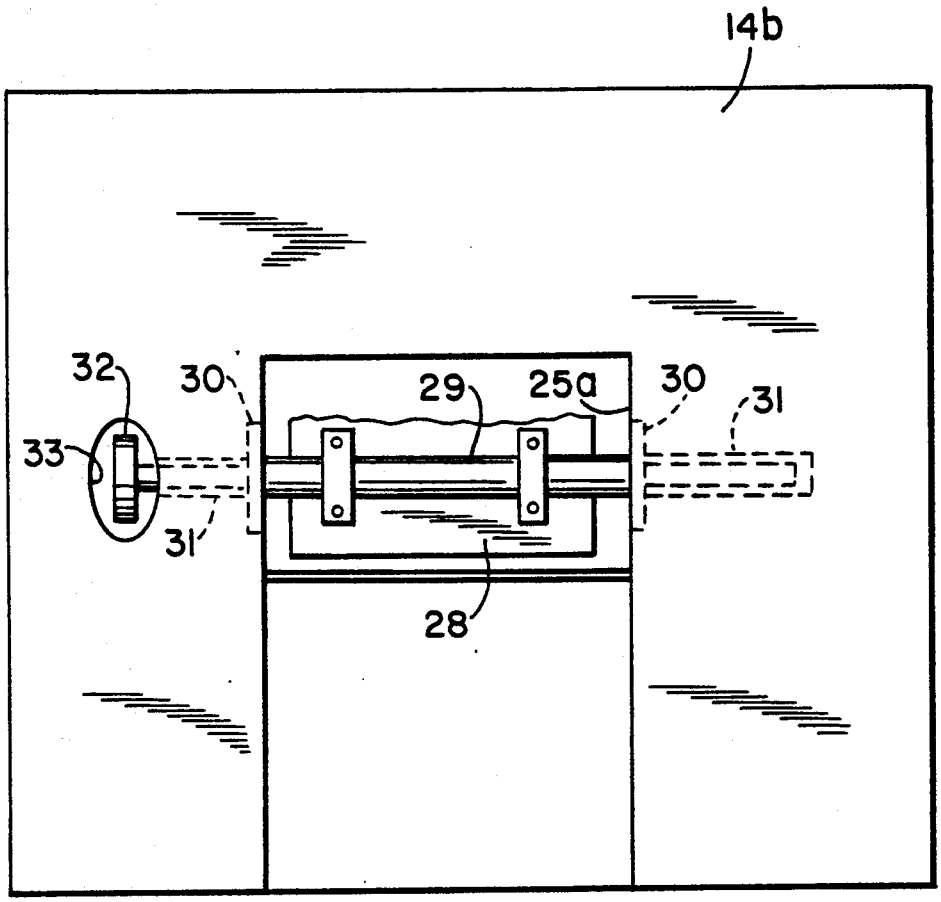
FIG. 4 is a view of the pillow structure of FIG. 3 from the rear thereof.

FIG. 3 and 4 illustrate an alternative structure embodying the invention. In this alternative structure a rotatabley mounted vane 28 is mounted in the cavity 25a of the pillow 14b in the path of the stream of water 27a from the nozzle 22a so that the angle at which the vane deflects the stream 27a downward can be adjusted by rotation of the vane 28. For this purpose the vane 28 is mounted on a rod 29 the ends of which are carried through bearings 30 that are embedded in the walls of the cavity 25a in pillow 14b. The ends of the rod 29 extend into wells 31 in the pillow Walls and the rod, and the vane 28 thereon, is rotated to a desired position of angular adjustment by a thumb wheel 32 mounted on the rod 29 within a well 33 in the pillow 14a.

Figure 5:
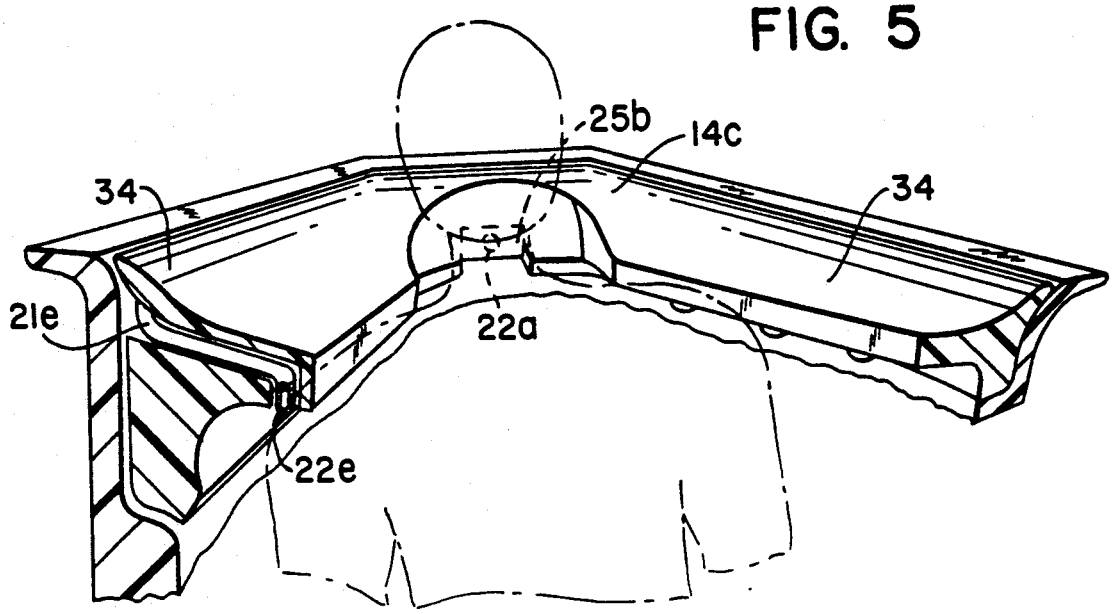
FIG. 5 is a perspective view, partly in section, of an embodiment of the invention in which the pillow structure includes wing elements that extend over the shoulders of a person in the repose station of the tub.
Figure 6:
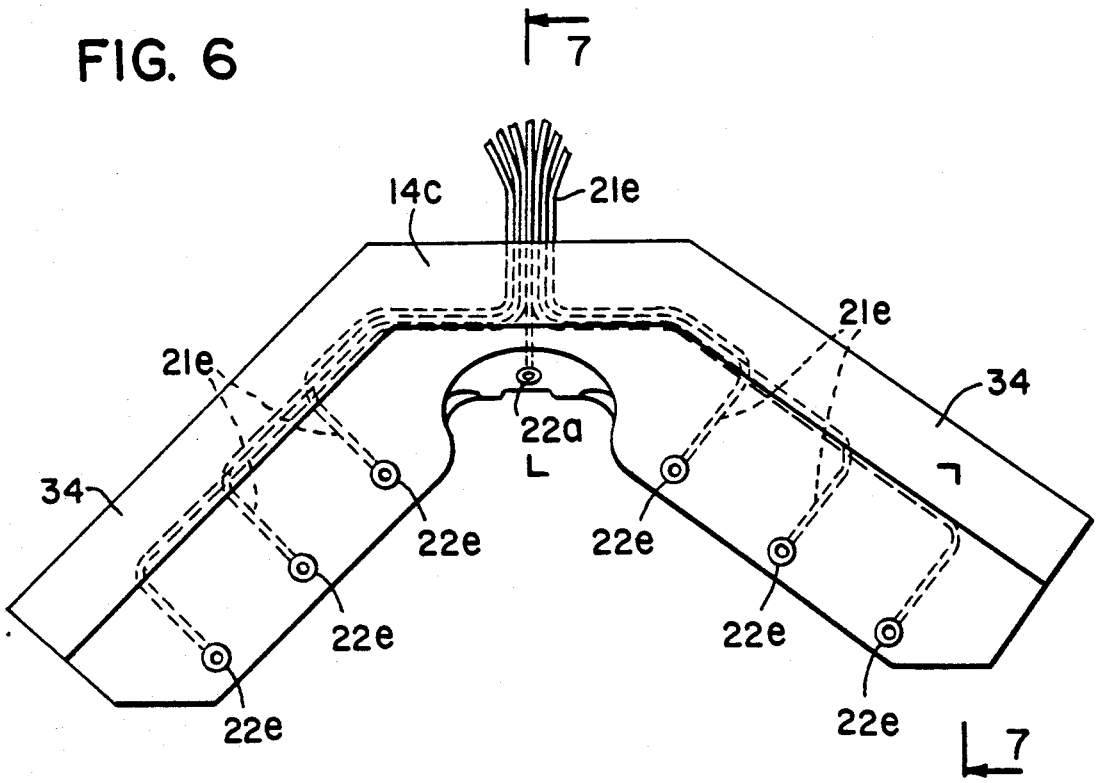
FIG. 6 is a view of the pillow structure with wing elements as shown in FIG. 5, but from the underside thereof.
Figure 7:
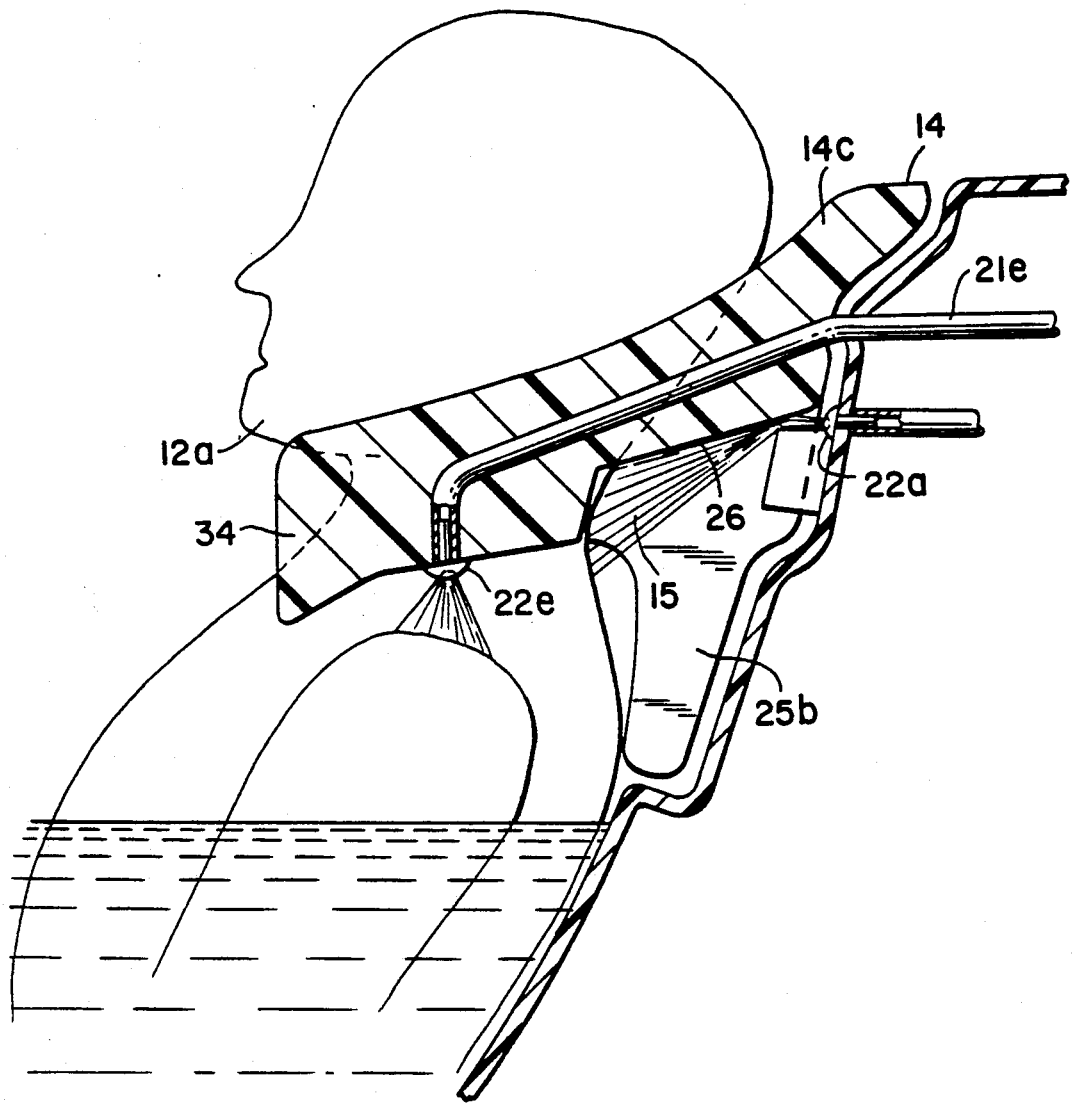
FIG. 7 is sectional view along the lines 7—7 of FIG. 6 showing a person in the repose station of this embodiment.

FIGS. 5, 6 and 7 illustrate another embodiment of the invention wherein a pillow structure 14c has a central portion essentially like the pillow 14a or 14b, just described above, with a cavity 25b and a nozzle 22a directing water under pressure into the cavity 25b to be deflected downward by the slanted cavity front wall 26 at an acute angle against the neck of a person 12 at the repose station, as illustrated in FIG. 7. But in addition this embodiment includes wing portions 34 of the pillow 14c to extend over the shoulders of a person 12a at the repose station as illustrated in FIG. 7. In this embodiment hoses 21e, like the hoses 21a–d described with reference to FIGS. 1 and 2, carry streams of heated water under pressure from the pump and heater unit 20 to nozzles, in this instance to nozzles 22e which are at spaced intervals along the underside of the wing portions 34 of the pillow 14c so as to impinge down on the shoulders of a person in the repose position.

What is claimed is:

1. A hydrotherapy hot tub having a station consisting of a generally vertical wall portion having an upper edge for supporting the back, head and neck of a person at said station, a conduit from a source of fluid under pressure for directing a stream of said fluid through a nozzle which is on an end of said conduit and which is mounted through said wall portion for directing said stream toward the head and neck of a person at said station, a surface adapted to be interposed in said stream and angularly disposed relative thereto for deflecting said stream to impinge at an acute angle on the neck of a person at said station, a housing, said housing adapted to be mounted on said upper edge, said housing having substantially flat top and bottom surfaces, said housing further shaped to form wing portions which are adapted to extend over respective shoulders of a person, and additional conduits having first and second ends, respectively, said first ends of said additional conduits in connection with said source of fluid under pressure, said second ends of said additional conduits extending into said wing portions and in connection with a plurality of nozzles, respectively, at spaced intervals in said bottom surface of said wing portions, said nozzles being disposed to direct streams of said fluid downward onto the shoulders of a person at said station.

2. The hydrotherapy hot tub of claim 1 in which said surface for deflecting said stream of said fluid through said wall toward the head and neck of a person at said station is angularly adjustable for adjusting the acute angle at which said stream impinges on the neck of a person at said station.

3. A hydrotherapy hot tub having a station which includes a generally vertical wall portion with a pillow attached to said wall portion near its upper edge, said station being adapted to support a person's back against said wall portion with the back of that person's head and neck adjacent to said pillow, said pillow having a cavity in its central portion opening through its front thereby opening toward the back of a person's head and neck which is adjacent to said pillow, a conduit from a source of fluid under pressure opening through a nozzle into said cavity through the rear of the cavity for directing a stream of said fluid in a direction through said cavity toward the back of a person's head which is adjacent to said pillow, and means deflecting said stream of fluid at an acute angle downward from the horizontal so as to impinge at an acute angle on the neck of a person, the back of whose head is adjacent to said pillow.

4. The hydrotherapy hot tub of claim 3 in which said means for deflecting said stream of fluid at an angle is a front wall portion of said pillow interposed in the path of said stream at an angle thereto.

5. The hydrotherapy hot tub of claim 3 in which said means for deflecting said stream of fluid at an angle is an angularly adjustable vane interposed in the path of said stream.

6. The hydrotherapy hot tub of claim 3 in which said stream deflecting means is angularly adjustable for adjusting the acute angle at which said stream impinges on the neck of a person at said station.

7. The hydrotherapy hot tub of claim 3 in which said stream deflecting means is an interior wall of said cavity interposed in said stream at an angle thereto.

* * * * *